US008459361B2

(12) United States Patent
Leuchtenberg

(10) Patent No.: US 8,459,361 B2
(45) Date of Patent: Jun. 11, 2013

(54) MULTIPART SLIDING JOINT FOR FLOATING RIG

(75) Inventor: Christian Leuchtenberg, Jakarta (ID)

(73) Assignee: Halliburton Energy Services, Inc., Houston, TX (US)

( * ) Notice: Subject to any disclaimer, the term of this patent is extended or adjusted under 35 U.S.C. 154(b) by 1325 days.

(21) Appl. No.: 11/734,243

(22) Filed: Apr. 11, 2007

(65) Prior Publication Data

US 2008/0251257 A1 Oct. 16, 2008

(51) Int. Cl.
*E21B 17/01* (2006.01)

(52) U.S. Cl.
USPC ..... 166/355; 166/344; 166/367; 405/224.2

(58) Field of Classification Search
USPC ..... 166/355, 367, 368, 352; 405/224.2–224.4
See application file for complete search history.

(56) References Cited

U.S. PATENT DOCUMENTS

| | | | | |
|---|---|---|---|---|
| 3,643,751 | A | 2/1972 | Crickmer | |
| 3,729,941 | A | 5/1973 | Rochelle | |
| 4,098,333 | A | 7/1978 | Wells et al. | |
| 4,099,582 | A | 7/1978 | Bell | |
| 4,135,841 | A | 1/1979 | Watkins | |
| 4,167,215 | A * | 9/1979 | Thorne | 166/341 |
| 4,291,772 | A | 9/1981 | Beynet | |
| 4,351,027 | A | 9/1982 | Gay et al. | |
| 4,351,261 | A | 9/1982 | Shanks | |
| 4,367,981 | A | 1/1983 | Shapiro | |
| 4,411,434 | A | 10/1983 | Lewis | |
| 4,615,542 | A | 10/1986 | Ideno et al. | |
| 4,616,707 | A | 10/1986 | Langner | |
| 4,626,135 | A * | 12/1986 | Roche | 405/224.2 |
| 4,668,126 | A | 5/1987 | Burton | |
| 4,712,620 | A * | 12/1987 | Lim et al. | 166/355 |
| 5,069,488 | A * | 12/1991 | Freyer et al. | 285/302 |
| 5,095,667 | A | 3/1992 | Ryan et al. | |
| 5,184,681 | A * | 2/1993 | Fontenot | 166/367 |
| 5,341,724 | A | 8/1994 | Vatel | |
| 5,484,024 | A * | 1/1996 | Ladd et al. | 166/369 |
| 5,658,095 | A | 8/1997 | Arlt et al. | |
| 5,727,630 | A * | 3/1998 | Brammer | 166/355 |

(Continued)

FOREIGN PATENT DOCUMENTS

| | | |
|---|---|---|
| WO | WO9005236 | 5/1990 |
| WO | 9858152 A1 | 12/1998 |
| WO | WO0201038 | 1/2002 |
| WO | 2008127894 A | 10/2008 |

OTHER PUBLICATIONS

Cameron Marine Systems, Telescoping Joint drawing No. P/N 649148-01-00-00, undated.

(Continued)

*Primary Examiner* — Matthew Buck
(74) *Attorney, Agent, or Firm* — Smith IP Services, P.C.

(57) ABSTRACT

A system for interconnecting a floating rig and a riser assembly includes a rotating control device permitting pressurization of the riser assembly; and a sliding joint connected to the rotating control device, the sliding joint being longitudinally extendable and compressible while the riser assembly is pressurized. Another system includes a sliding joint including more than two telescoping sleeves, and the sliding joint being longitudinally extendable and compressible while the riser assembly is pressurized at the surface. An apparatus includes a sliding joint with multiple sets of telescoping sleeves, each set including at least two of the sleeves. Another apparatus includes a sliding joint with multiple radially overlapping seal assemblies.

20 Claims, 13 Drawing Sheets

U.S. PATENT DOCUMENTS

| | | | | |
|---|---|---|---|---|
| 5,875,848 | A * | 3/1999 | Wolff et al. | 166/345 |
| 6,017,168 | A * | 1/2000 | Fraser et al. | 405/224.4 |
| 6,173,781 | B1 * | 1/2001 | Milne et al. | 166/355 |
| 6,230,824 | B1 | 5/2001 | Peterman et al. | |
| 6,263,982 | B1 * | 7/2001 | Hannegan et al. | 175/7 |
| 6,278,937 | B1 | 8/2001 | Ishida et al. | |
| 6,470,975 | B1 | 10/2002 | Bourgoyne et al. | |
| 6,530,430 | B2 | 3/2003 | Reynolds | |
| 6,626,438 | B2 * | 9/2003 | Walden | 277/510 |
| 6,732,804 | B2 | 5/2004 | Hosie et al. | |
| 6,739,395 | B2 | 5/2004 | Reynolds | |
| 7,021,402 | B2 | 4/2006 | Beato et al. | |
| 7,032,691 | B2 | 4/2006 | Humphreys | |
| 7,090,036 | B2 | 8/2006 | deBoer | |
| 7,159,669 | B2 * | 1/2007 | Bourgoyne et al. | 166/382 |
| 2003/0044239 | A1 | 3/2003 | Finn et al. | |
| 2003/0111799 | A1 * | 6/2003 | Gilmore | 277/510 |
| 2005/0061546 | A1 | 3/2005 | Hannegan | |
| 2006/0021755 | A1 * | 2/2006 | Radi et al. | 166/345 |
| 2006/0151176 | A1 | 7/2006 | Moe | |
| 2006/0157236 | A1 | 7/2006 | Walker et al. | |
| 2008/0105462 | A1 * | 5/2008 | May et al. | 175/7 |

OTHER PUBLICATIONS

Cooper Industries, Telescoping Joint drawing No. SK-46423-01, dated Jul. 1992.

Drilling Contractor, "MPD Techniques Address Problems in Drilling Southeast Asia's Fractured Carbonate Structures," dated, Nov./Dec. 2006.

OTC 14263, "New Revision of Drilling Riser Recommended Practice," dated 2002.

SPE Distinguished Lecturer Series, "Managed Pressure Drilling; A New Way of Looking at Drilling Hydraulics . . . Overcoming Conventional Drilling Challenges," dated 2006-2007.

Cameron Marine Systems drawing No. 649148-01-00-00, undated.

Pacific Rim Drilling, "MPD Techniques Address Problems in Drilling Southeast Asia's Fractured Carbonate Structures," dated, Nov./Dec. 2006.

SPE 2006-2007 Distinguished Lecturer Series, "Managed Pressure Drilling," dated 2006/2007.

Cooper Industries drawing No. SK-46423-01, dated 1992.

International Search Report and Written Opinion issued Dec. 1, 2008, for International Application No. PCT/US08/59426, 9 pages.

International Preliminary Report on Patentability issued Oct. 22, 2009, for International Patent Application Serial No. PCT/US08/59426, 8 pages.

Great Britain Examination Report issued Jul. 5, 2011 for GB Patent Application No. GB0917107.5, 2 pages.

Great Britain Examination Report issued Feb. 2, 2012 for GB Patent Application No. GB1121000.2, 2 pages.

* cited by examiner

MULTIPART SLIDING JOINT FOR FLOATING RIG

BACKGROUND

The present invention relates generally to equipment utilized and operations performed in conjunction with a subterranean well and, in an embodiment described herein, more particularly provides a multipart sliding joint for use with a floating rig.

Slip joints have been widely used for interconnecting a riser assembly to a floating rig. Floating rigs may be drill ships, semi-submersibles, floating drilling or production platforms, etc., and may be dynamically positioned, tethered, or otherwise maintained in position. A slip joint basically allows a riser assembly to alternately lengthen and shorten as a floating rig moves up and down (heaves) in response to wave action.

Recent developments in drilling and completion technology (such as managed pressure drilling) benefit from use of an internally pressurized riser assembly. Unfortunately, typical slip joints and methods of interconnecting riser assemblies to floating rigs are unsuited for use with pressurized riser assemblies, and/or are suited for use only in very benign environments, for example, environments with very limited rig heave.

In FIG. 1 a conventional riser assembly 10 and floating rig 12 are illustrated. A lower end of the riser assembly 10 is connected to a blowout preventer (BOP) stack 14, which is in turn connected to a wellhead 16 at the ocean floor or mudline. An upper end of the riser assembly 10 is connected via a slip joint 18, flow spool 20 and diverter 22 to a rig floor 24 typically having a rotary table 36 or top drive (not shown).

In this example, the slip joint 18 provides an attachment point for tensioner cables 26 which apply consistent tension to the riser assembly 10 as the rig 12 heaves. The slip joint 18 includes inner and outer telescoping sleeves or barrels 28, 30, with the tensioner cables 26 being attached to the outer barrel and the inner barrel being connected to the flow spool 20 and diverter 22. Thus, as the rig 12 heaves, the inner barrel 28 (which is connected to the rig floor 24 via the flow spool 20 and diverter 22) moves up and down relative to the outer barrel 30 (which is connected to the remainder of the riser assembly 10 therebelow).

Seals may be provided between the inner and outer barrels 28, 30, but in the past these seals have only been designed for containing relatively low pressures (such as 500 psi), in substantial part due to large manufacturing tolerances, requiring large seals with considerable wear allowance. In addition, the FIG. 1 example is unsuited for operations such as managed pressure drilling, in part because no rotating control device is provided to isolate the interior of the riser assembly 10 from the atmosphere at the surface. Instead, the diverter 22 and flow spool 20 vent the upper end of the riser assembly 10 to atmosphere, for example, via a mud tank 32, gas flare lines, etc.

Another reason the FIG. 1 example is unsuited for operations such as managed pressure drilling is that drilling mud returns are circulated via a choke 38, separator 40 and shale shaker 42 to the mud tank 32 without benefit of an annular seal (such as a rotating control device) to allow application of back pressure by the choke during circulation and drilling.

In FIG. 2 another example of a method of interconnecting the riser assembly 10 and floating rig 12 is illustrated. In this example, the BOP stack 14 is located at an upper end of the riser assembly 10, and the tensioner cables 26 are connected via a tensioner ring 44 and adapter 46 below the BOP stack.

Ball or flex joints 48 are interconnected between the slip joint 18 and the diverter 22, and between the slip joint and the BOP stack 14. Similar flex joints 48 may be used in the example of FIG. 1 above the slip joint 18.

It will be appreciated that, if the BOP stack 14 is to be maintained above water level 50, the available stroke of the slip joint 18 in the example of FIG. 2 has to be significantly reduced as compared to the example of FIG. 1. Thus, the FIG. 2 example is unsuited for use in environments in which substantial heave is encountered. In addition, the FIG. 2 example is unsuited for use with a pressurized riser assembly 10 since the diverter 22 vents the upper end of the riser assembly to atmosphere and no annular seal (such as a rotating control device) is provided.

With the BOP stack 14 positioned above water level 50, the BOP stack is of the type well known to those skilled in the art as a "surface" BOP stack. A surface BOP stack may include a single annular or ram blowout preventer, or a combination of annular and ram blowout preventers (such as a multiple cavity blowout preventer with dual annular blowout preventers on top), or a combination of multiple annular blowout preventers, or another blowout preventer configuration adopted for a particular drilling purpose.

In an attempt to alleviate the problem of reduced slip joint stroke and limited heave capability of the FIG. 2 example, the BOP stack 14 has been repositioned below water level 50 as illustrated in FIG. 3. However, this configuration introduces additional problems associated with access to the submerged BOP stack 14, extended length control and circulation lines, etc. In addition, the FIG. 3 example is still unsuited for use with a pressurized riser assembly 10.

In FIG. 4 an attempt to provide for a pressurized riser assembly 10 is illustrated. In this example, a rotating control device 52 is connected above the flow spool 20, and the flow spool is connected to the slip joint 18 via an adapter 54. A rotating control device is well known to those skilled in the art as providing a seal about a rotating tubular therein, thereby allowing maintenance of a pressure differential between the annulus above and below the seal while the tubular rotates within the device.

Importantly, the slip joint 18 is locked in its stroked closed (fully compressed) position, and so the slip joint provides no compensation at all for heave of the rig 12. Instead, the rig floor 24 displaces up and down relative to the upper end of the riser assembly 10 (at the rotating control device 52).

Relative lateral displacement between the upper end of the riser assembly 10 and the rig 12 is also permitted, with only the relatively flexible tensioner cables 26 and the intermittent presence of a drill pipe 56 passing through the rotary table 36 and into the rotating control device 52 being used to limit this lateral displacement. It will be appreciated that such lateral displacement is very undesirable (especially when the drill pipe 56 is not present) and significantly limits the allowable heave for the FIG. 4 example.

Therefore, it may be clearly seen that improvements are needed in the art of interconnecting floating rigs and riser assemblies.

SUMMARY

In carrying out the principles of the present invention, a sliding joint and associated system for interconnecting floating rigs and riser assemblies are provided which solve at least one problem in the art. One example is described below in which the sliding joint is compact when compressed, but has a relatively large stroke length. Another example is described below in which a multipart sliding joint can be interconnected between a rotating control device and a diverter.

In one aspect, a system for interconnecting a floating rig and a riser assembly is provided. The system includes a rotating control device permitting pressurization of the riser assembly, and a sliding joint connected to the rotating control device. The sliding joint is longitudinally extendable and compressible while the riser assembly is pressurized.

In another aspect, a system for interconnecting a floating rig and a riser assembly includes a sliding joint including more than two telescoping sleeves. The sliding joint is longitudinally extendable and compressible while the riser assembly is pressurized at the surface.

In yet another aspect, a sliding joint is provided as an apparatus for use in interconnecting a floating rig and a riser assembly. The sliding joint includes multiple radially overlapping seal assemblies.

In a further aspect, an apparatus includes a sliding joint for use in interconnecting a floating rig and a riser assembly includes multiple sets of telescoping sleeves. Each set of sleeves includes at least two of the sleeves.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction away from the earth's center, and "below", "lower", "downward" and similar terms refer to a direction toward the earth's center.

Figure 1:
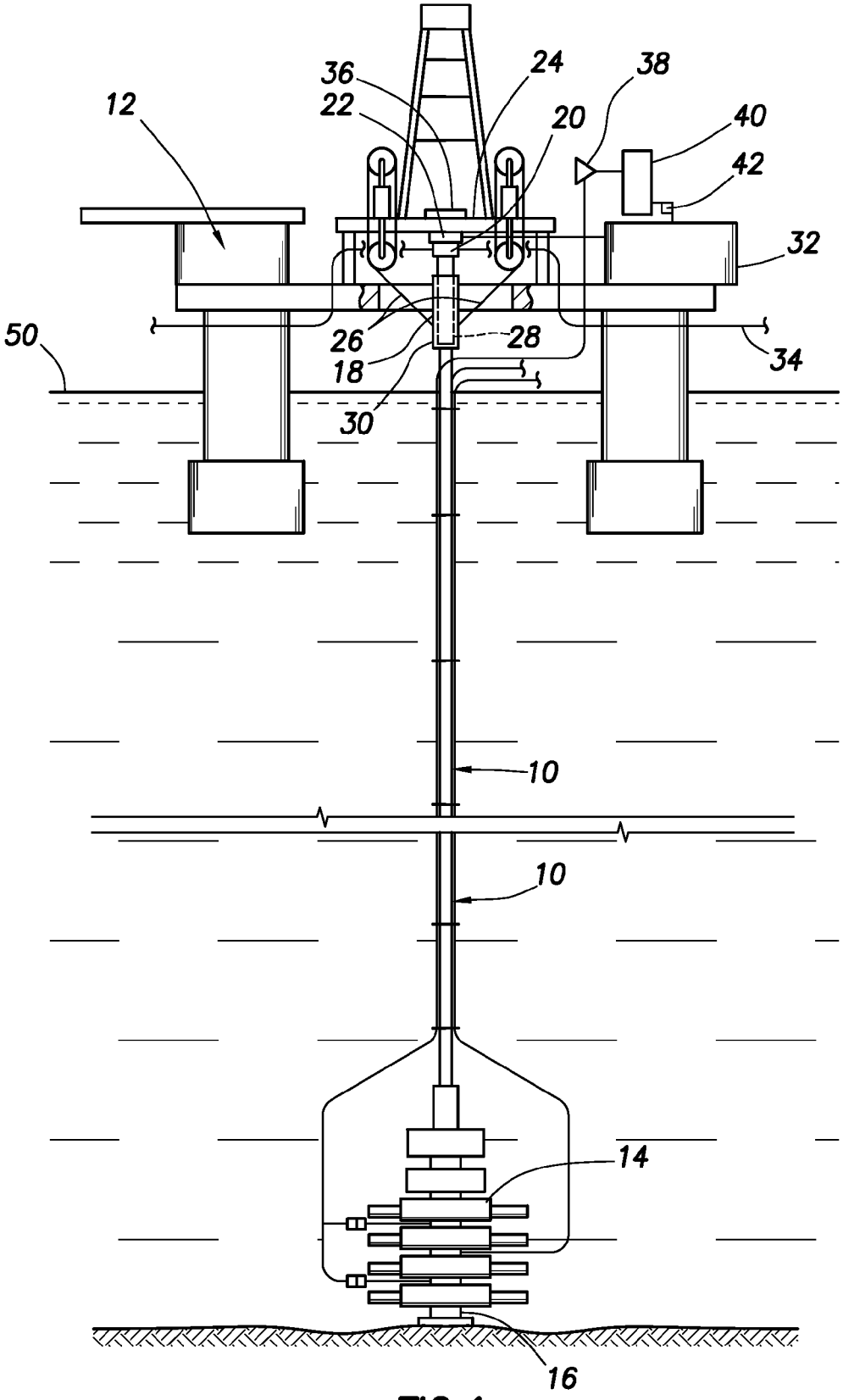
FIG. 1 (PRIOR ART)
FIGS. 1-4 are elevational views of prior art floating rigs and riser assemblies.
Figure 3:
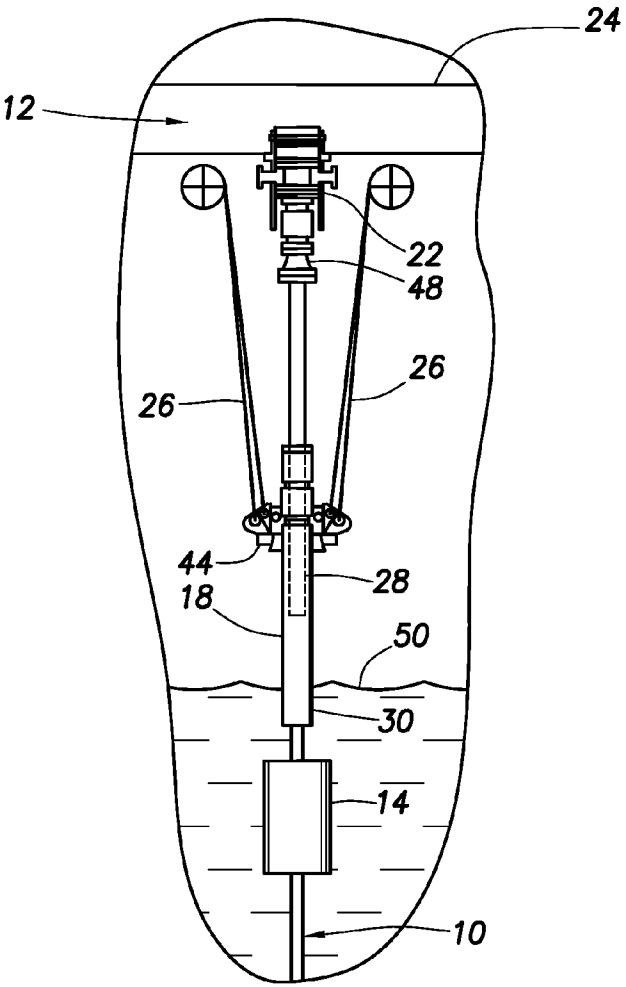
FIG.3 (PRIOR ART)
Figure 2:
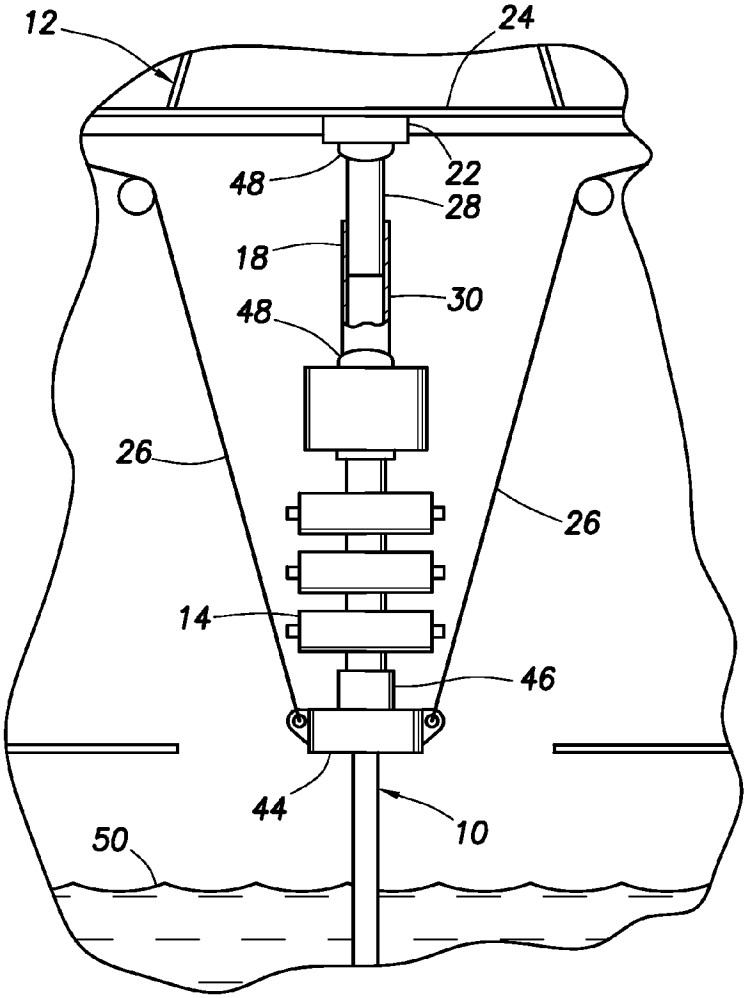
FIG.2 (PRIOR ART)
Figure 4:
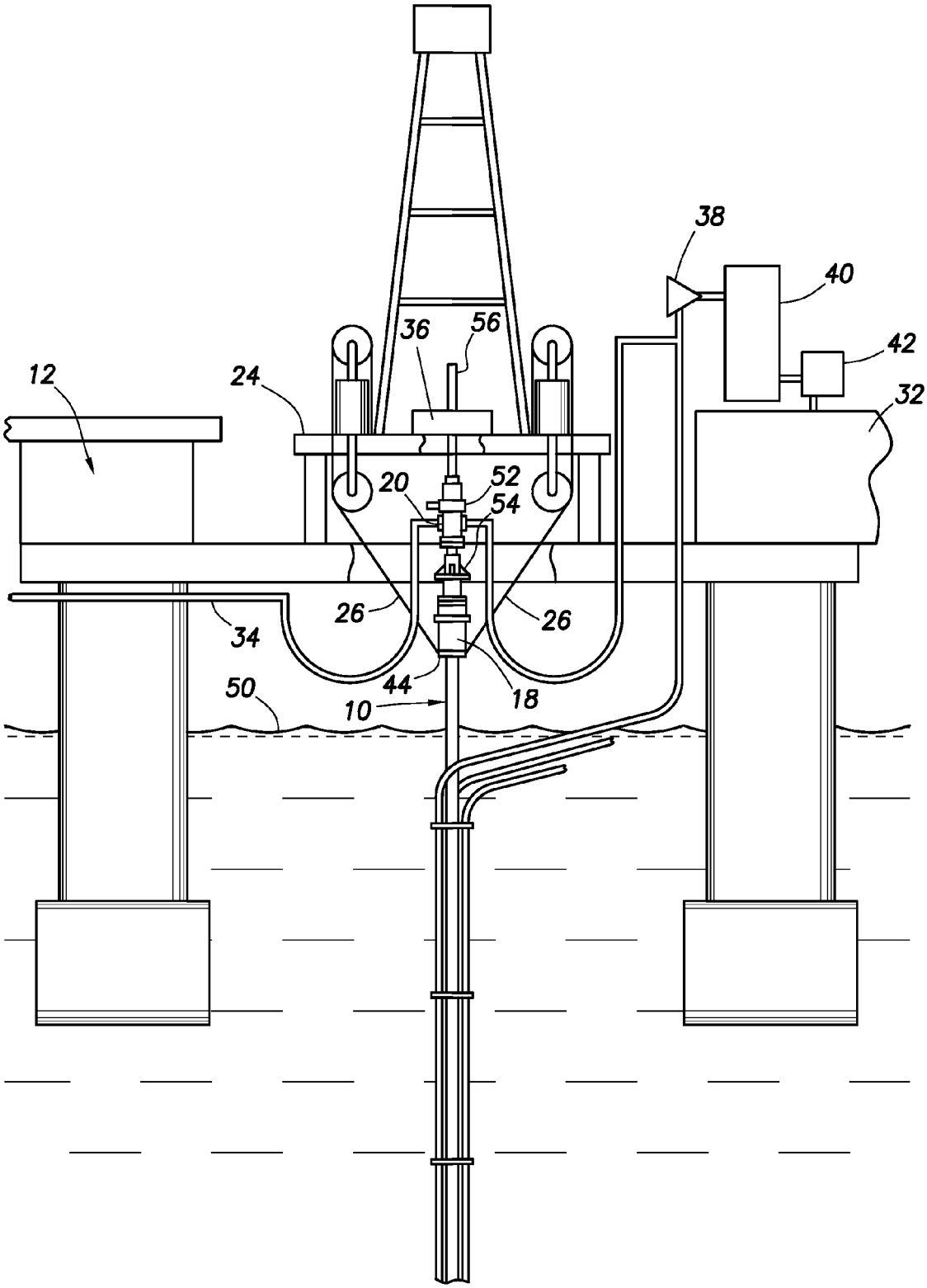
FIG.4 (PRIOR ART)
Figure 5:
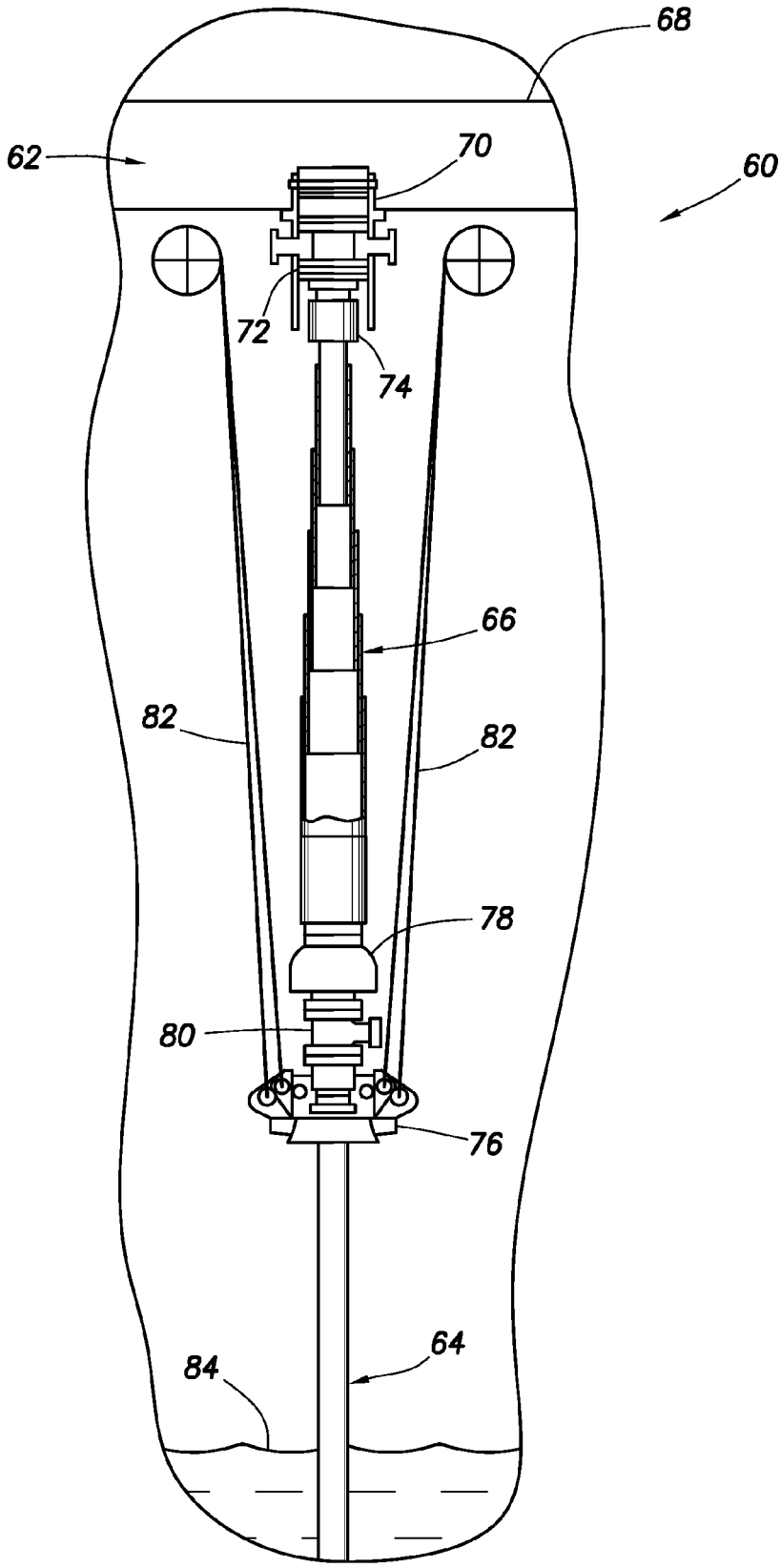
FIG. 5 is a schematic elevational view of a multipart sliding joint and associated system for interconnecting a floating rig and riser assembly embodying principles of the present invention.

Representatively and schematically illustrated in FIG. 5 is a system 60 for interconnecting a floating rig 62 and a riser assembly 64 which embodies principles of the present invention. The system 60 preferably includes a multipart sliding joint 66 which provides several beneficial features to the system. Among these features are the capability to use a pressurized riser assembly 64 in operations such as managed pressure drilling, the ability to do so in environments in which substantial rig heaves are encountered, and securing the upper end of the riser assembly against lateral displacement relative to a floor 68 of the rig 62.

A diverter housing 70 is attached to the rig floor 68, and a diverter 72 of conventional design is received in the housing. A ball or flex joint 74 is connected between the diverter 72 and an upper end of the sliding joint 66. Thus, the upper end of the sliding joint 66 is secured against lateral displacement relative to the rig floor 68.

A lower end of the sliding joint 66 is connected to a rotating control device 78. The rotating control device 78 provides a rotating annular seal between the upper end of the riser assembly 64 and a drill string or other tubular string within the rotating control device. In this manner, the riser assembly 64 below the rotating control device 78 may be pressurized in operations such as managed pressure drilling.

A flow spool 80 is connected below the rotating control device 78 for flow communication with the interior of the riser assembly 64 below the rotating control device. A tensioner ring 76 may be connected below the flow spool 80 for attachment of tensioner cables 82. Other types of tensioning devices (such as inline hydraulic cylinders, etc.) may be used, if desired.

The sliding joint 66 is specially constructed with multiple telescoping sleeves, overlapping seal assemblies and other features in this embodiment which provide for a relatively large stroke length, but with a relatively short compressed length. In this manner, substantial heave can be compensated for with the sliding joint 66, but the sliding joint can still be accommodated between the rotating control device 78 and the flex joint 74, while still maintaining the tensioner ring 76 and upper end of the riser assembly 64 above water level 84.

Figure 6A:
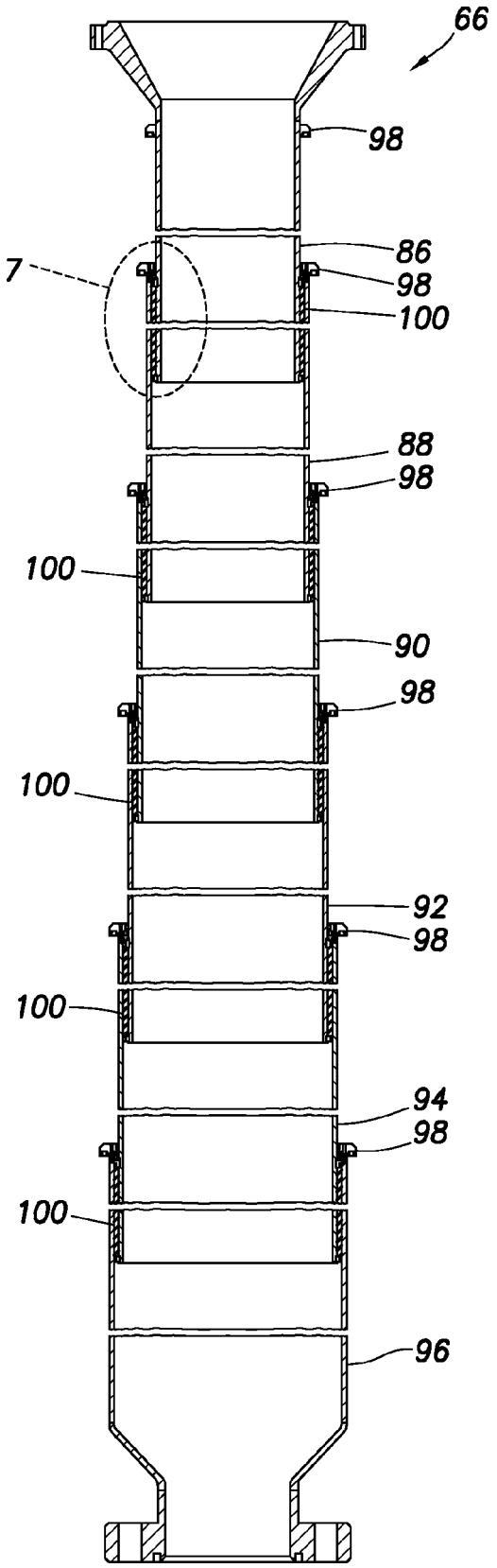
FIGS. 6A & B are schematic cross-sectional views of the multipart sliding joint of FIG. 5 depicted in respective extended and compressed configurations.

Referring additionally now to FIGS. 6A & B, enlarged scale cross-sectional views of the sliding joint 66 are representatively illustrated. In FIG. 6A the sliding joint 66 is depicted in its fully extended configuration, and in FIG. 6B the sliding joint is depicted in its fully compressed configuration. The difference in length between these two configurations is the stroke length of the sliding joint 66.

The stroke length of the sliding joint 66 is relatively large due in part to the multiple sets of telescoping sleeves 86, 88, 90, 92, 94, 96 included in the sliding joint. In the embodiment of FIGS. 6A & B, there are six of the sleeves 86, 88, 90, 92, 94, 96, but greater or lesser numbers of sleeves may be used, if desired.

Figure 6B:
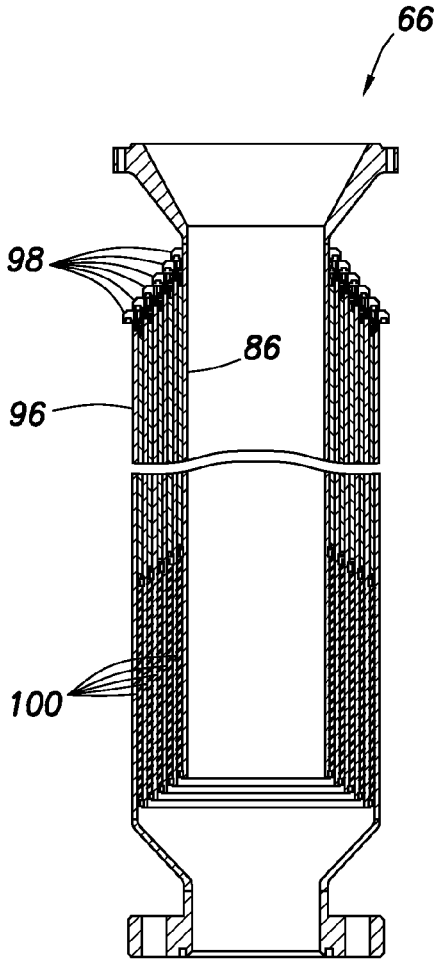

The fully compressed length of the sliding joint 66 is relatively small due in part to the manner in which the sleeves 86, 88, 90, 92, 94, 96 almost completely overlap each other in the compressed configuration of FIG. 6B. Only an upper stop ring 98 on each of the sleeves 86, 88, 90, 92, 94 prevents each sleeve from being completely received within its respective outer telescoping sleeve.

Figure 14:
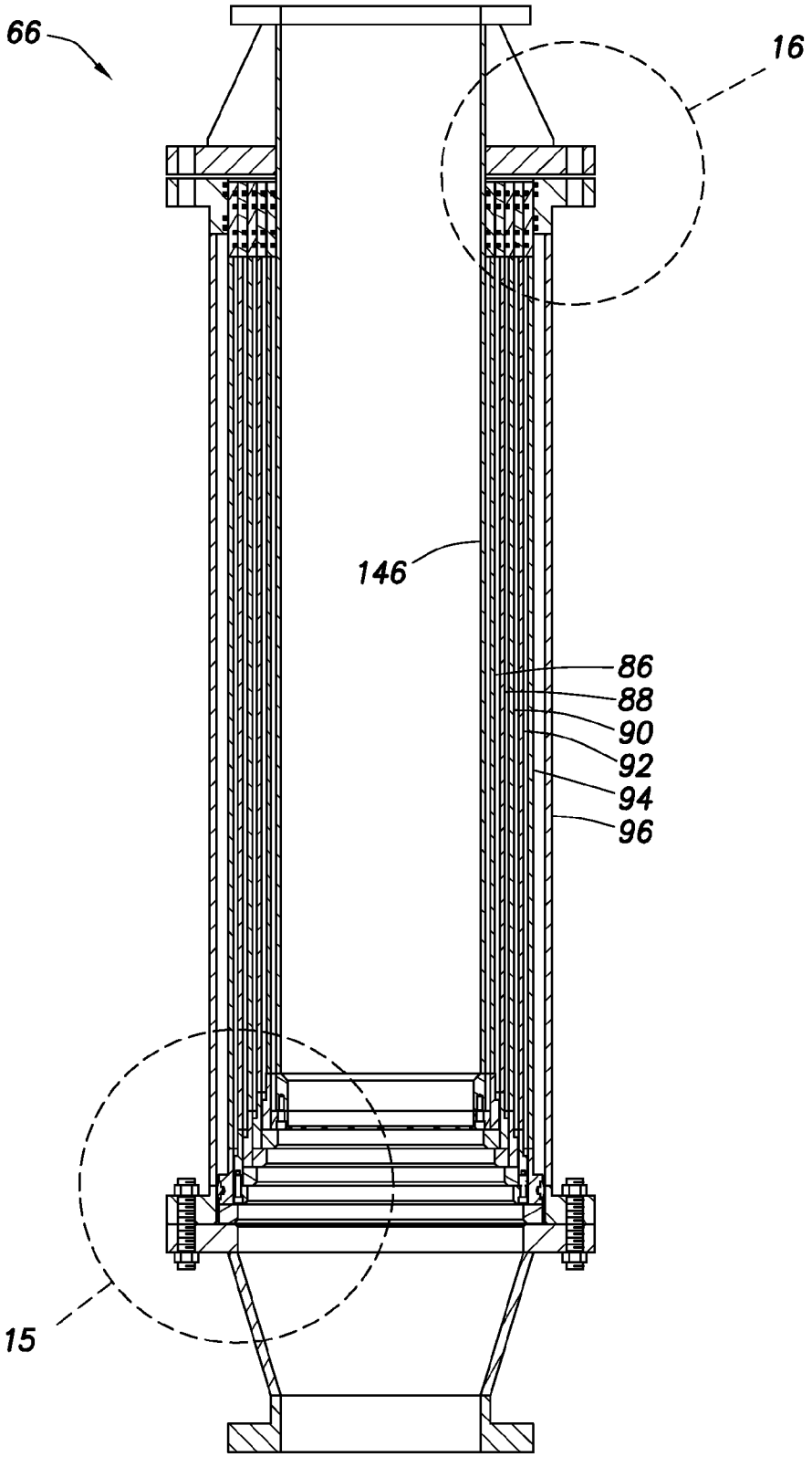
FIGS. 14-16 are schematic cross-sectional views of an alternate configuration of the multipart sliding joint.

Note that in the alternate configuration of the sliding joint 66 depicted in FIG. 14, the upper stop ring 98 is not used.

Seal assemblies 100 carried on lower ends of the sleeves 86, 88, 90, 92, 94 are specially constructed to allow the seal assemblies to radially overlap each other in the compressed configuration of FIG. 6B. Each seal assembly 100 (other than the innermost seal assembly) radially outwardly overlies a next radially inwardly positioned one of the seal assemblies. This is a significant advantage over prior designs in which seal assemblies do not overlap and result in relatively long compressed lengths.

Figure 7:
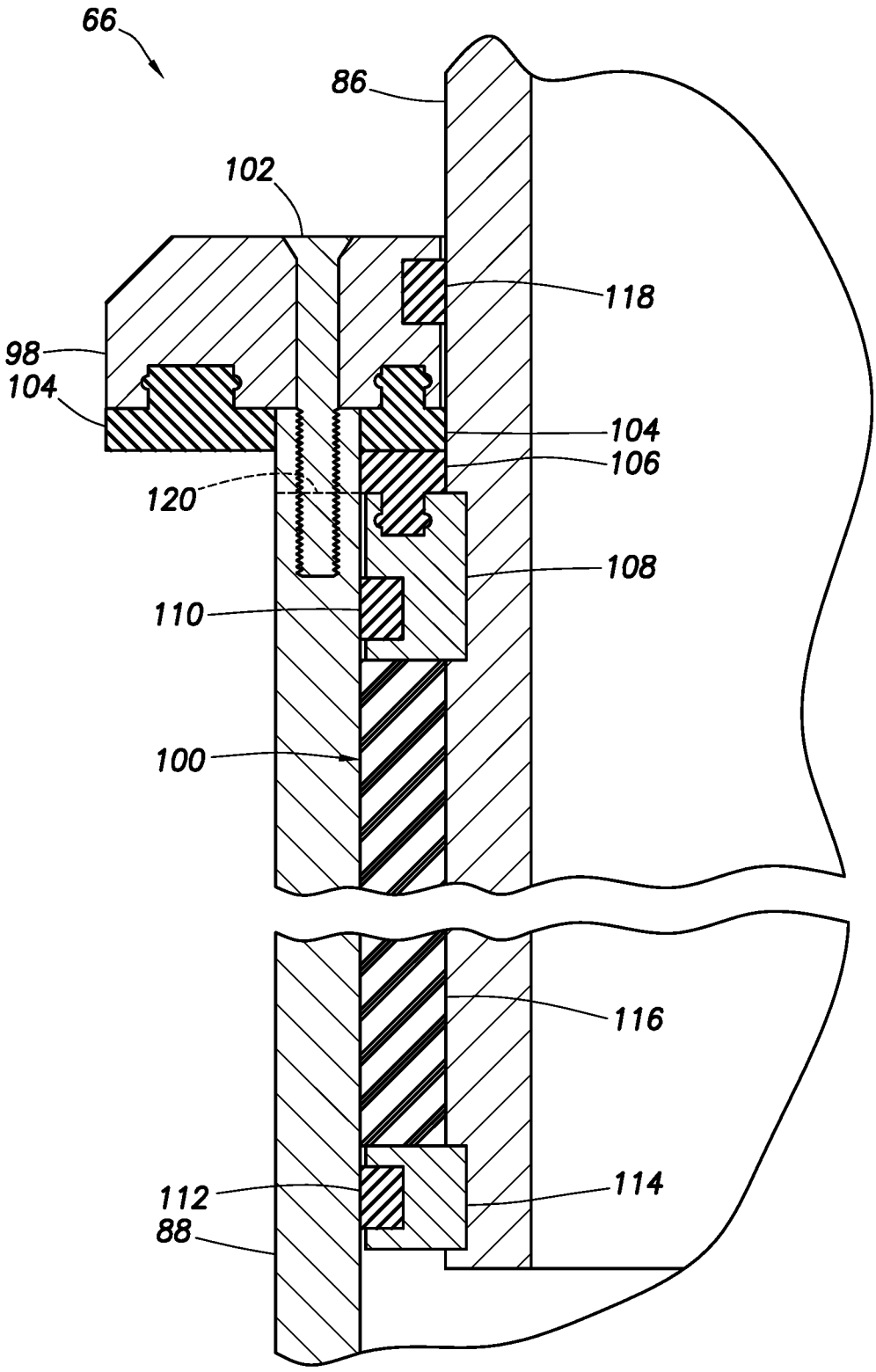
FIGS. 7 & 8 are schematic cross-sectional views of alternate seal assembly configurations which may be used in the multipart sliding joint.

Referring additionally now to FIG. 7, an enlarged scale cross-sectional view of overlapping portions of the sleeves 86, 88 is representatively illustrated. In this view, preferred manners of constructing the stop rings 98 and seal assemblies 100 may be more clearly seen.

The stop ring 98 is secured to an upper end of the sleeve 88 using fasteners 102, such as bolts. This arrangement allows for convenient maintenance and access to the seal assembly 100.

In addition, resilient shock absorber rings 104 are interference fit into grooves on a lower side of the stop ring 98 to reduce shock loads transferred between the sleeves 86, 88. The outer shock absorber ring 104 will contact the stop ring 98 on the upper end of the sleeve 90 when the sliding joint 66 is in its fully compressed configuration, and the inner shock absorber ring 104 will engage an upper end of the seal assembly 100 on the sleeve 86 (as depicted in FIG. 7) when the sliding joint is in its fully extended configuration.

A similar shock absorber ring 106 is attached at an upper end of the seal assembly 100. The shock absorber ring 106 is interference fit into a groove on an upper side of a seal ring 108 attached to the sleeve 86.

The seal lock ring 108 carries a glide ring 110 for preventing direct contact with an interior surface of the sleeve 88. A similar glide ring 112 is carried on another seal lock ring 114 attached at a lower end of the sleeve 86. Sealing material 116 (such as V-packing, chevron seals, etc.) is preferably retained between the seal lock rings 108, 114.

A wiper ring 118 is carried internally on the stop ring 98 and engages an outer surface of the sleeve 86. The wiper ring 118 prevents debris from infiltrating between the sleeves 86, 88 and degrading the sealing capability of the seal assembly 100.

Slots 120 or other openings may extend between the interior and exterior of the sleeve 88 to allow escape of fluid, air, etc. from between the stop ring 98 and the seal assembly 100 when the sliding joint 66 is extended, and to allow air or other fluid to enter when the sliding joint is compressed.

Figure 8:
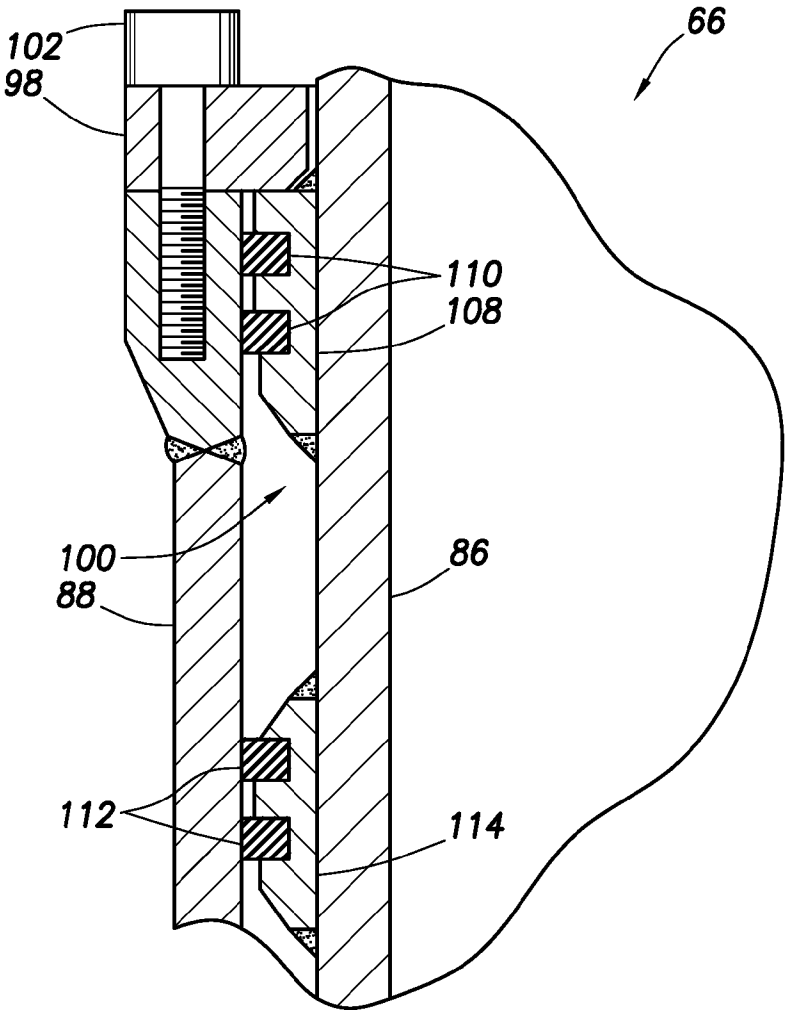

Note that many other configurations are possible for the sleeves 86, 88, 90, 92, 94, 96 and the associated stop rings 98 and seal assemblies 100. In FIG. 8 another configuration is representatively illustrated in which multiple seals 110, 112 are carried on each of the respective seal carrier rings 108, 114 and the sealing material 116 is not necessarily retained between the seal rings.

In addition, the configuration of FIG. 8 does not utilize the shock absorber rings 104, 106 or wiper ring 118. However, these elements could be provided in the configuration of FIG. 8, if desired.

Figure 9:
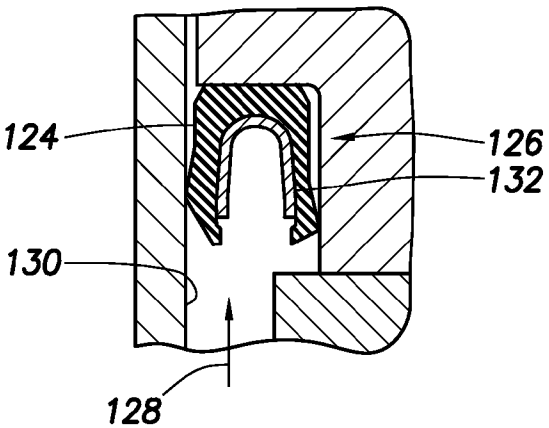
FIG. 9 is a cross-sectional view of a seal configuration which may be used in the seal assembly of FIG. 8.

In FIG. 9, an enlarged scale cross-sectional view of a seal configuration 126 which may be used for the seals 110, 112 is representatively illustrated. The seal configuration 126 includes a generally U-shaped outer sealing body 124 which is concave in a direction facing an application of increased pressure 128.

This orientation of the outer body 124 results in increased sealing force against a seal surface 130 as the pressure 128 increases. A resilient inner spring member 132 is provided to exert a biasing force against the outer body 124 and thereby supply an initial sealing force against the seal surface 130.

Figure 10:
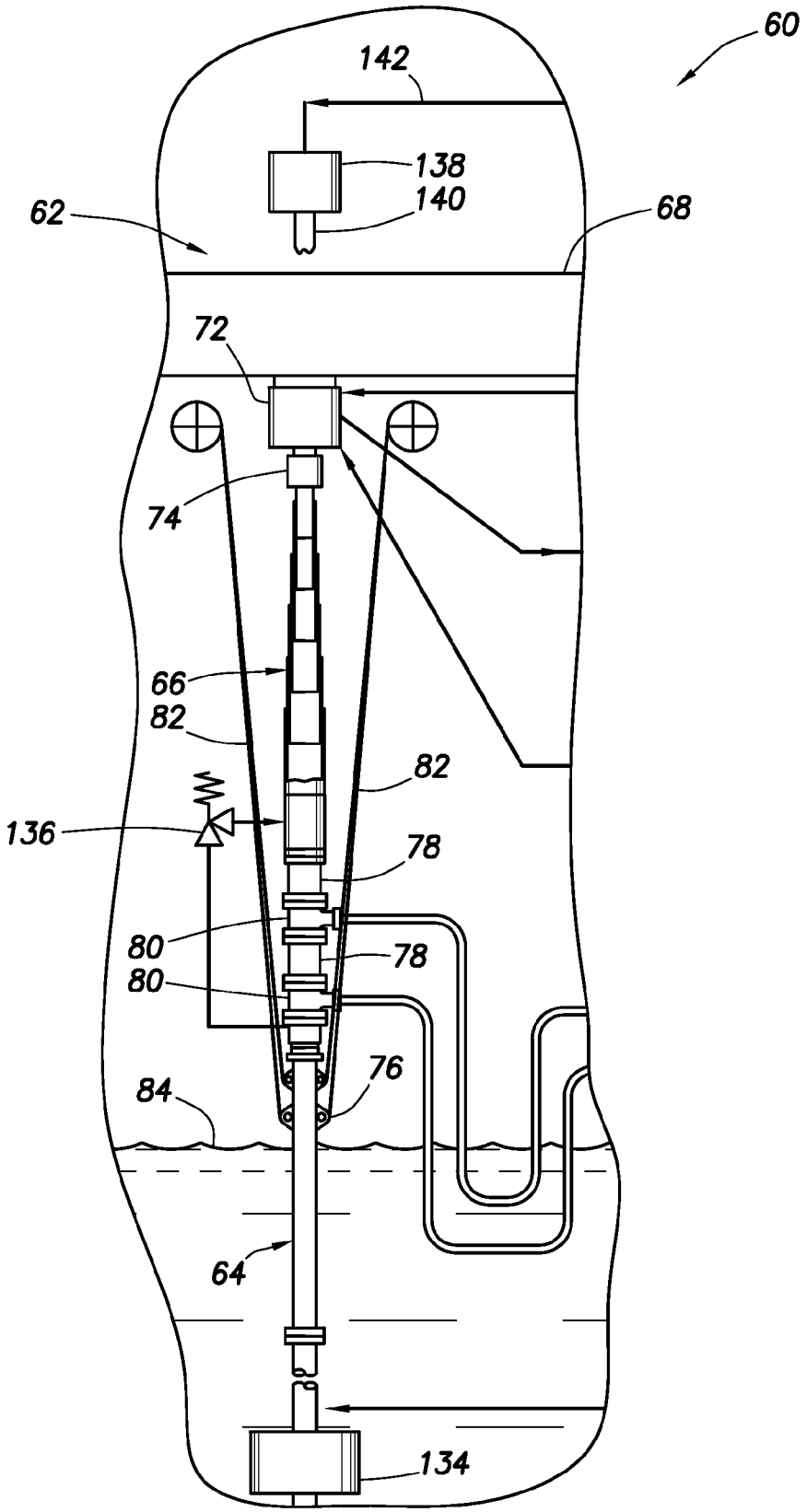
FIG. 10 is a schematic elevational view of a first alternate configuration of the system of FIG. 5.

Referring additionally now to FIG. 10, an alternate configuration of the system 60 is representatively illustrated. In this configuration, the sliding joint 66 includes seven barrels or sleeves, multiple rotating control devices 78 and flow spools 80 are used, and the tensioner cables 82 are attached at rings 76 on an outer barrel of a conventional slip joint which, without its inner barrel, serves as a part of the riser assembly 64.

A ball or flex joint 134 having relatively high pressure holding capability may be used in the riser assembly 64 since the riser assembly will preferably be pressurized. A safety valve 136 is used to relieve overpressure in the riser assembly 64 below the rotating control devices 78.

The upper rotating control device 78 could be a passive device (e.g., having an interference fit annular sealing element), and the lower rotating control device could be an active device (e.g., having a hydraulically actuated annular seal element).

A top drive 138 is used to convey and rotate a drill string 140, and to communicate circulating drilling fluid 142 through the drill string. Thus, it will be appreciated that the embodiment of FIG. 10 demonstrates that many variations to the system 60 are possible in keeping with the principles of the invention.

Furthermore, it is not necessary for the multipart sliding joint 66 to be used only in the system 60. The sliding joint 66 could, for example, be substituted for the slip joint 18 in any of the otherwise conventional examples of FIGS. 1-4, without departing from the principles of the invention. Indeed, the sliding joint 66 could be used in any system for interconnecting a floating rig to a riser assembly.

Note that in the system 60 as depicted in FIGS. 5 & 10, the rotating control device(s) 78 is/are advantageously positioned between the sliding joint 66 and the point of suspension of the riser assembly 64 (e.g., the tensioner ring 76 or other points of attachment of the tensioner cables or other tensioning devices to the riser assembly).

In addition, the sliding joint 66 is advantageously positioned between the rotating control device 78 and the diverter 72, with the diverter being rigidly secured and stationary relative to the rig floor 68. No relative lateral or vertical displacement is permitted between the diverter 72 and the rig floor 68.

Figure 11:
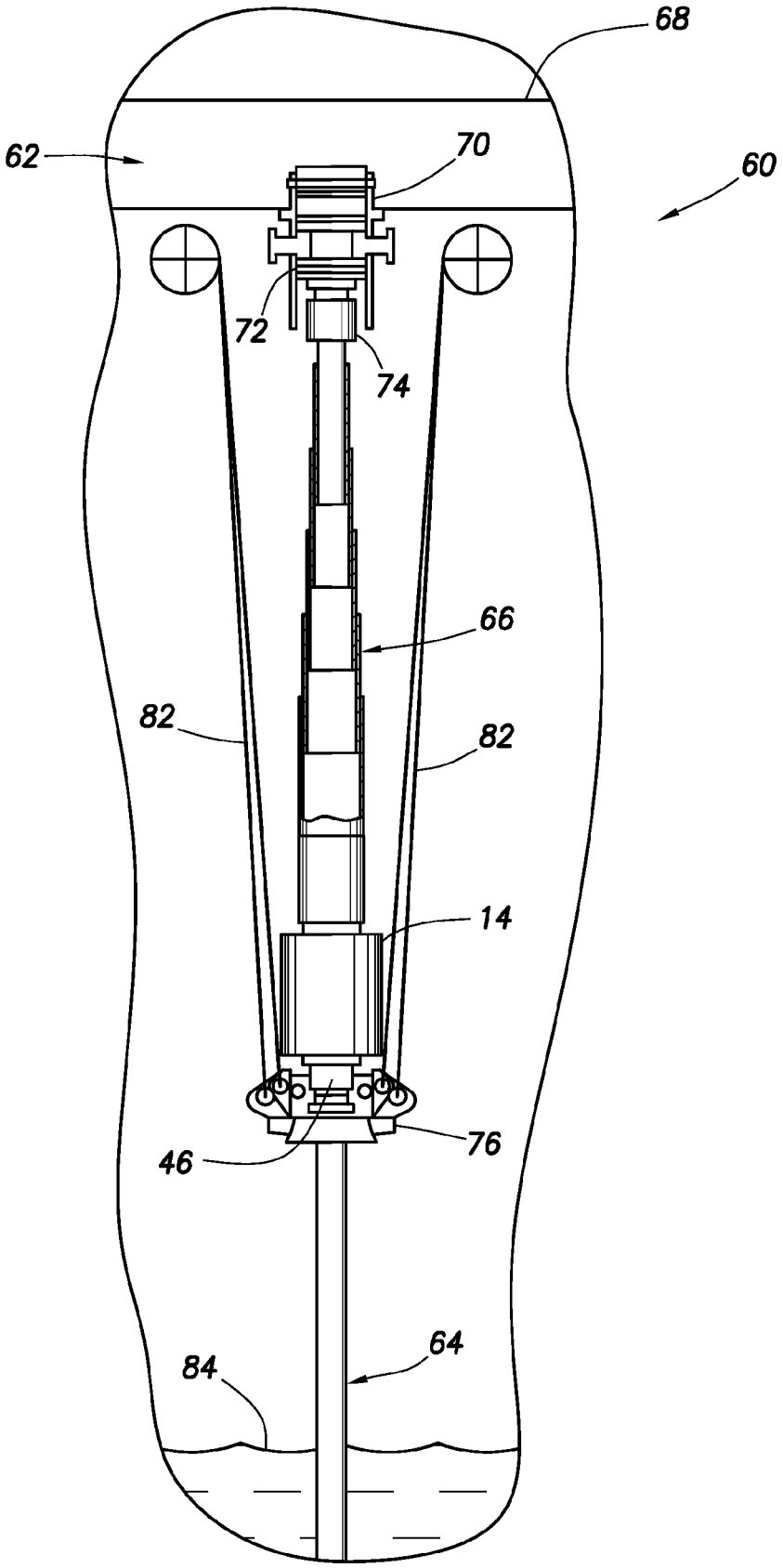
FIG. 11 is a schematic elevational view of a second alternate configuration of the system of FIG. 5.
Figure 12:
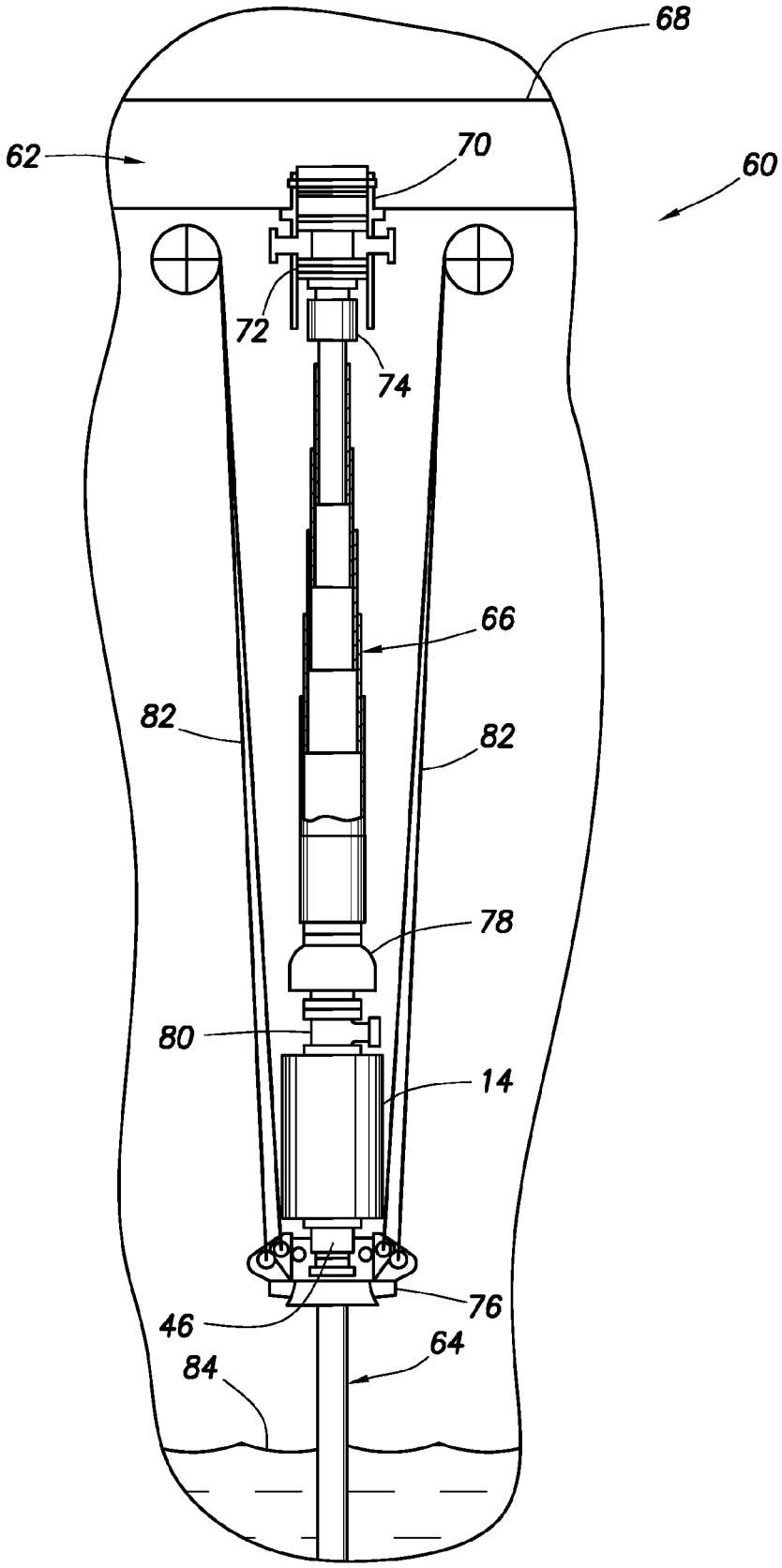
FIG. 12 is a schematic elevational view of a third alternate configuration of the system of FIG. 5.
Figure 13:
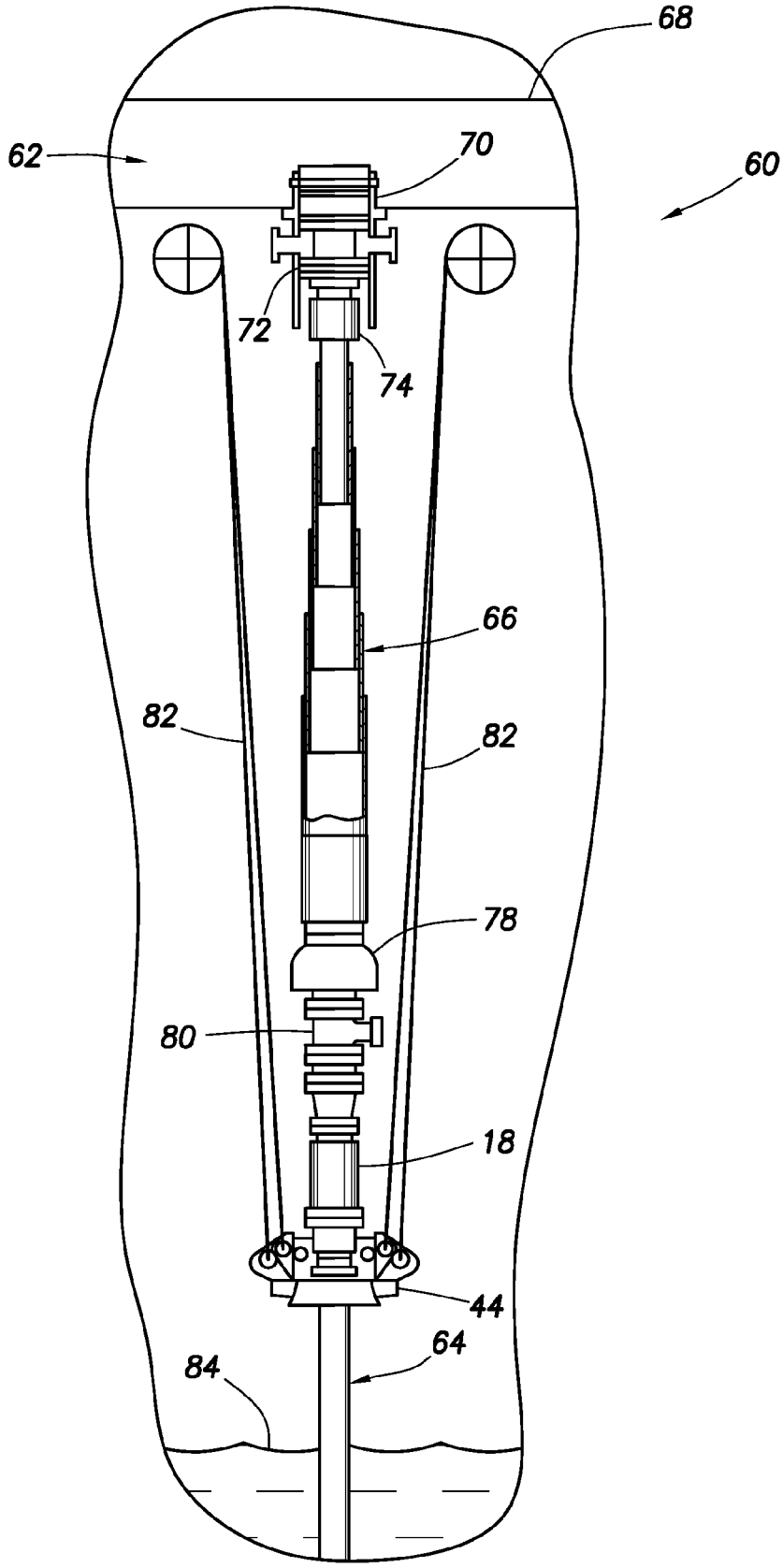
FIG. 13 is a schematic elevational view of a fourth alternate configuration of the system of FIG. 5.

FIGS. 11-13 schematically depict several additional alternate configurations of the system 60, in which the sliding joint 66 is used for interconnecting floating rigs and riser assemblies. In FIG. 11, the surface BOP stack 14 is interconnected between the sliding joint 66 and the adapter 46 on the tensioner ring 76. This configuration allows use of the BOP stack 14 above the water level 84, while still permitting use of the fully functional longitudinally extendable and compressible sliding joint 66 in environments in which significant heave is encountered.

In FIG. 12, the rotating control device 78 and flow spool 80 are interconnected between the sliding joint 66 and the surface BOP stack 14. As with the FIG. 11 configuration, this FIG. 12 configuration allows use of the BOP stack 14 above the water level 84, while still permitting use of the fully functional longitudinally extendable and compressible sliding joint 66 in environments in which significant heave is encountered. In addition, the FIG. 12 configuration permits use with a pressurized riser assembly 64 for operations such as managed pressure drilling.

In FIG. 13, the slip joint 18 is interconnected below the rotating control device 78 and flow spool 80. However, the slip joint 18 is locked in its closed configuration (as in the example of FIG. 4). In this manner, the built-in tensioner attachment 44 on the outer barrel 30 of the slip joint 18 provides for convenient attachment of the cables 82, but unlike the FIG. 4 example the assembly is secured to the rig floor 68 and the sliding joint 66 is fully functional to allow use in environments in which significant heave is encountered.

Figure 16:
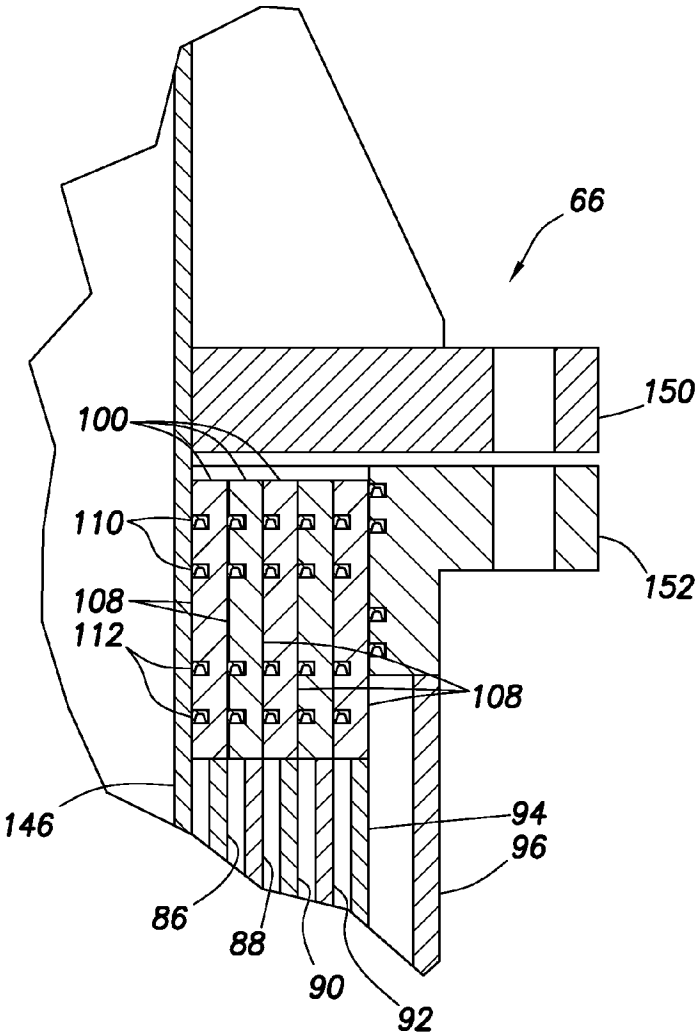
Figure 15:
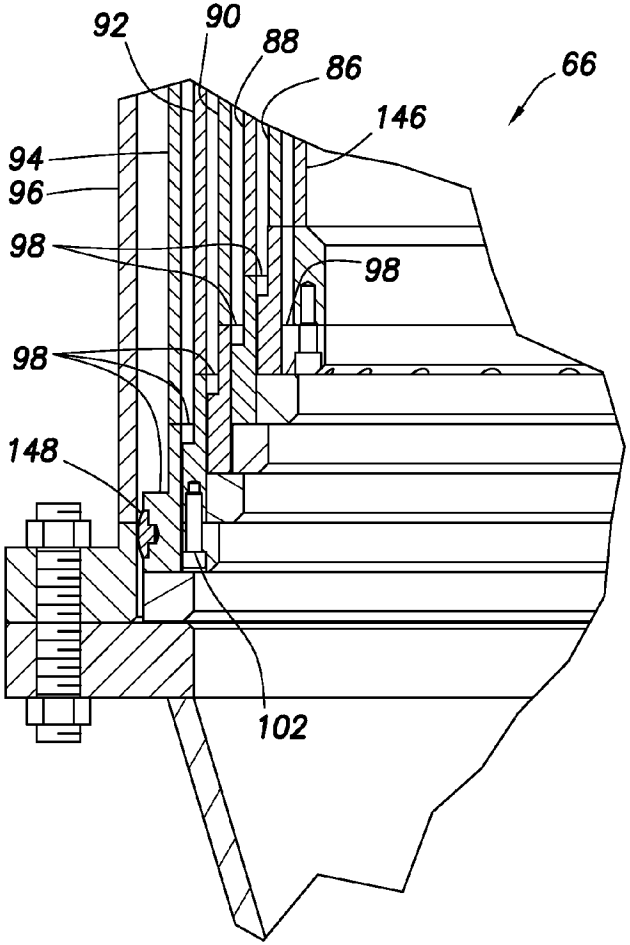

An alternate configuration of the multipart sliding joint 66 is representatively illustrated in FIGS. 14-16. In this configuration, the sliding joint 66 includes seven of the telescoping sleeves 86, 88, 90, 92, 94, 96, 146. In addition, the seals 110, 112 are carried internally and sealingly contact exterior surfaces of the respective next radially inwardly underlying one of the sleeves 86, 88, 90, 92, 94, 146.

Note that the stop rings 98 are internal to the sliding joint 66, and are attached at lower ends of the sleeves 86, 88, 90, 92, 94, 146. Glide rings 148 may be carried on each of the stop rings 98 (although only one of the glide rings is depicted in FIG. 15) to prevent radial contact between the sleeves 86, 88, 90, 92, 94, 96, 146.

The seals 110, 112 are preferably of the configuration 126 depicted in FIG. 9, but other types of seals may be used if desired. In addition, wiper rings (such as the wiper ring 118 described above) may be provided to prevent debris from entering between the sleeves 86, 88, 90, 92, 94, 96, 146.

If desired, the sliding joint 66 may be locked closed by installing suitable bolts or other fasteners in the flanges 150, 152 depicted in FIG. 16.

It may now be fully appreciated that the multipart sliding joint 66 and the system 60 described above provide many improvements in the art of interconnecting floating rigs and riser assemblies. These improvements include, but are not limited to, the use of pressurized riser assemblies in challenging environments with substantial rig heave, and provisions for technologically advanced drilling and completion operations (such as managed pressure drilling, etc.).

The foregoing detailed description has thus presented multiple examples of a system 60 for interconnecting a floating rig 62 and a riser assembly 64. In one embodiment, the system 60 includes the rotating control device 78 permitting pressurization of the riser assembly 64, and the sliding joint 66 connected to the rotating control device. The sliding joint 66 may be longitudinally extendable and compressible while the riser assembly 64 is pressurized.

The sliding joint 66 may be interconnected longitudinally between the rotating control device 78 and the diverter 72. Preferably, the diverter 72 is stationary relative to the rig floor 68.

The rotating control device 78 may be interconnected between the sliding joint 66 and the point of suspension for the riser assembly 64 (e.g., the tensioner ring 76, etc.).

The sliding joint 66 preferably includes multiple sets of telescoping sleeves 86, 88, 90, 92, 94, 96, 146. The sliding joint 66 may include six or more of the sleeves. The sliding joint may include multiple radially overlapping seal assemblies 100. Each seal assembly 100 may radially outwardly overlie a next radially inwardly positioned one of the seal assemblies.

The system 60 for interconnecting the floating rig 62 and the riser assembly 64 may include the sliding joint 66 having more than two telescoping sleeves, with the sliding joint being longitudinally extendable and compressible while the riser assembly is pressurized at the surface.

The rotating control device 78 may be interconnected between the sliding joint 66 and the blowout preventer stack 14. The blowout preventer stack 14 may be positioned above water level 84.

The rotating control device 78 may be interconnected between the sliding joint 66 and the slip joint 18 locked in a closed position thereof.

In various embodiments of apparatus described above, the sliding joint 66 may include multiple sets of telescoping sleeves, with each set including at least two of the sleeves. For example, the sliding joint 66 may include at least six of the sleeves 86, 88, 90, 92, 94, 96, 146.

In various embodiments, the sliding joint 66 may include multiple radially overlapping seal assemblies 100. Each seal assembly 100 may radially outwardly overlie a next radially inwardly positioned one of the seal assemblies.

Of course, a person skilled in the art would, upon a careful consideration of the above description of representative embodiments of the invention, readily appreciate that many modifications, additions, substitutions, deletions, and other changes may be made to these specific embodiments, and such changes are within the scope of the principles of the present invention. Accordingly, the foregoing detailed description is to be clearly understood as being given by way of illustration and example only, the spirit and scope of the present invention being limited solely by the appended claims and their equivalents.

What is claimed is:

1. A system for interconnecting a floating rig and a riser assembly, the system comprising:

a rotating control device permitting pressurization of the riser assembly, the rotating control device including an annular seal about a tubular string extending longitudinally through the rotating control device; and a sliding joint connected to the rotating control device, the sliding joint being longitudinally extendable and compressible while the riser assembly is pressurized, wherein the sliding joint includes multiple radially overlapping seal assemblies.

2. The system of claim 1, wherein the sliding joint is interconnected longitudinally between the rotating control device and a diverter.

3. The system of claim 2, wherein the diverter is stationary relative to a rig floor.

4. The system of claim 1, wherein the rotating control device is interconnected between the sliding joint and a point of suspension for the riser assembly.

5. The system of claim 1, wherein the sliding joint includes multiple sets of telescoping sleeves.

6. The system of claim 5, wherein the sliding joint includes at least six of the sleeves.

7. The system of claim 1, wherein each seal assembly radially outwardly overlies a next radially inwardly positioned one of the seal assemblies.

8. The system of claim 1, wherein the rotating control device is interconnected between the sliding joint and a blowout preventer stack.

9. The system of claim 8, wherein the blowout preventer stack is positioned above water level.

10. The system of claim 1, wherein the rotating control device is interconnected between the sliding joint and a slip joint locked in a closed position thereof.

11. A system for interconnecting a floating rig and a riser assembly, the system comprising:

a sliding joint including more than two telescoping sleeves, each of the sleeves extending circumferentially about an interior of the sliding joint, the sliding joint being longitudinally extendable and compressible while the riser assembly is pressurized at the surface, and the sliding joint including multiple radially overlapping seal assemblies.

12. The system of claim 11, wherein the sliding joint includes at least six of the sleeves.

13. The system of claim 11, wherein each seal assembly radially outwardly overlies a next radially inwardly positioned one of the seal assemblies.

14. The system of claim 11, further comprising a rotating control device.

15. The system of claim 14, wherein the sliding joint is interconnected longitudinally between the rotating control device and a diverter.

16. The system of claim 15, wherein the diverter is stationary relative to a rig floor.

17. The system of claim 14, wherein the rotating control device is interconnected between the sliding joint and a point of suspension for the riser assembly.

18. The system of claim 14, wherein the rotating control device is interconnected between the sliding joint and a blowout preventer stack.

19. The system of claim 18, wherein the blowout preventer stack is positioned above water level.

20. The system of claim 14, wherein the rotating control device is interconnected between the sliding joint and a slip joint locked in a closed position thereof.

* * * * *